US007395844B2

(12) United States Patent
Suzuki

(10) Patent No.: US 7,395,844 B2
(45) Date of Patent: Jul. 8, 2008

(54) PROCESSING APPARATUS AND METHOD OF PROCESSING

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 11/410,916

(22) Filed: Apr. 25, 2006

(65) Prior Publication Data

US 2006/0243349 A1 Nov. 2, 2006

Related U.S. Application Data

(63) Continuation of application No. PCT/JP2006/304198, filed on Feb. 28, 2006.

(30) Foreign Application Priority Data

Apr. 27, 2005 (JP) ..... 2005-130048

(51) Int. Cl.
*B27M 1/02* (2006.01)

(52) U.S. Cl. ..... 144/361; 144/3.1

(58) Field of Classification Search ..... 144/256.1, 144/256.3, 256.4, 361, 380, 1.1, 2.1, 3.1; 100/240, 245; 425/356, 394, 398
See application file for complete search history.

(56) References Cited

U.S. PATENT DOCUMENTS

| | | | | |
|---|---|---|---|---|
| 5,192,560 | A * | 3/1993 | Umetsu et al. | 425/175 |
| 5,343,913 | A | 9/1994 | Tanahashi et al. | |
| 6,113,378 | A * | 9/2000 | Tsuboi et al. | 425/352 |
| 2002/0011307 | A1 | 1/2002 | Fujii | |

FOREIGN PATENT DOCUMENTS

| | | |
|---|---|---|
| CA | 2100131 | 1/1995 |
| JP | 11-077619 | 3/1999 |
| JP | 3078452 | 6/2000 |

* cited by examiner

*Primary Examiner*—Shelley Self
(74) *Attorney, Agent, or Firm*—Hogan & Hartson LLP

(57) ABSTRACT

A method of processing a wooden piece taken out from a raw wood into a predetermined three-dimensional shape, includes compressing the wooden piece by applying compressive force thereto in a water vapor atmosphere of higher temperature and higher pressure than atmospheric air; and fracturing at least a portion of the compressed wooden piece by exposing the portion to the atmospheric air so as to cause explosion inside the exposed portion of the wooden piece.

6 Claims, 11 Drawing Sheets

PROCESSING APPARATUS AND METHOD OF PROCESSING

CROSS-REFERENCE TO RELATED APPLICATIONS

This application is a continuation of PCT international application Ser. No. PCT/JP2006/304198 filed Feb. 28, 2006 which designates the United States, incorporated herein by reference, and which claims the benefit of priority from Japanese Patent Application No. 2005-130048, filed Apr. 27, 2005, incorporated herein by reference.

BACKGROUND OF THE INVENTION

1. Field of the Invention

The present invention relates to a method of processing and a processing apparatus according to which wood is processed into a predetermined shape.

2. Description of the Related Art

In recent years, wooden materials that are natural materials attract attention. With a wide variety of grain patterns, wood products made of wood exhibit individual features depending on positions of the raw wood from which the particular wood products are cut out. Such individual features of each wood product give it a unique quality. In addition, surface flaws and discolorations caused by a long-term use create unique textures which tend to evoke warm and familiar feeling in the user. Thus, the wooden material attracts attention as a material for products of uniqueness and taste which cannot be found in products made of synthetic resin or light metals. Techniques for processing wooden materials are also developing dramatically.

According to one conventionally known technique for processing wooden materials: a wooden board is softened with water absorption and compressed; the compressed wooden board is cut along a direction substantially parallel with a direction in which the compressive force is applied, whereby a primary fixed product with a sheet-like shape is obtained; and the primary fixed product is deformed into a desired three-dimensional shape under heat and moisture (for example, see Japanese Patent No. 3078452 Publication). Further, according to another conventional technique, a softened wooden sheet is compressed and temporarily secured in a prepared mold and left in the mold until the wooden sheet recovers. Thus a wooden product with a desired shape can be obtained (see, for example, Japanese Patent Application Laid-Open No. H11-77619 Publication).

Conventionally, when it is required to form an opening or a cutout portion in a wooden piece, cutting, punching, die-cutting, or the like is performed on the wooden piece after the wooden piece is properly formed by compression.

SUMMARY OF THE INVENTION

A method according to one aspect of the present invention is of processing a wooden piece taken out from a raw wood into a predetermined three-dimensional shape, and includes compressing the wooden piece by applying compressive force thereto in a water vapor atmosphere of higher temperature and higher pressure than atmospheric air; and fracturing at least a portion of the compressed wooden piece by exposing the portion to the atmospheric air so as to cause explosion inside the exposed portion of the wooden piece.

A processing apparatus according to another aspect of the present invention includes a pair of metal molds that sandwiches a-wooden piece taken out from a raw wood and applies compressive force to the wooden piece; a movable metal mold that penetrates at least one of the metal molds, and is movable relative to the penetrated metal mold; and a drive unit that moves the movable metal mold relative to the metal mold penetrated by the movable metal mold. The compressive force is applied to the wooden piece by the metal molds and the movable metal mold in a water vapor atmosphere of higher temperature and higher pressure than atmospheric air. Then, the drive unit moves the movable metal mold to expose a portion of the wooden piece abutting the movable metal mold during compression to the atmospheric air to cause an explosion inside the exposed portion of the wooden piece which is fractured thereby.

DETAILED DESCRIPTION OF THE PREFERRED EMBODIMENTS

Preferred embodiments (hereinafter simply referred to as the embodiments) of the present invention will be described in detail below with reference to the accompanying drawings.

Figure 1:
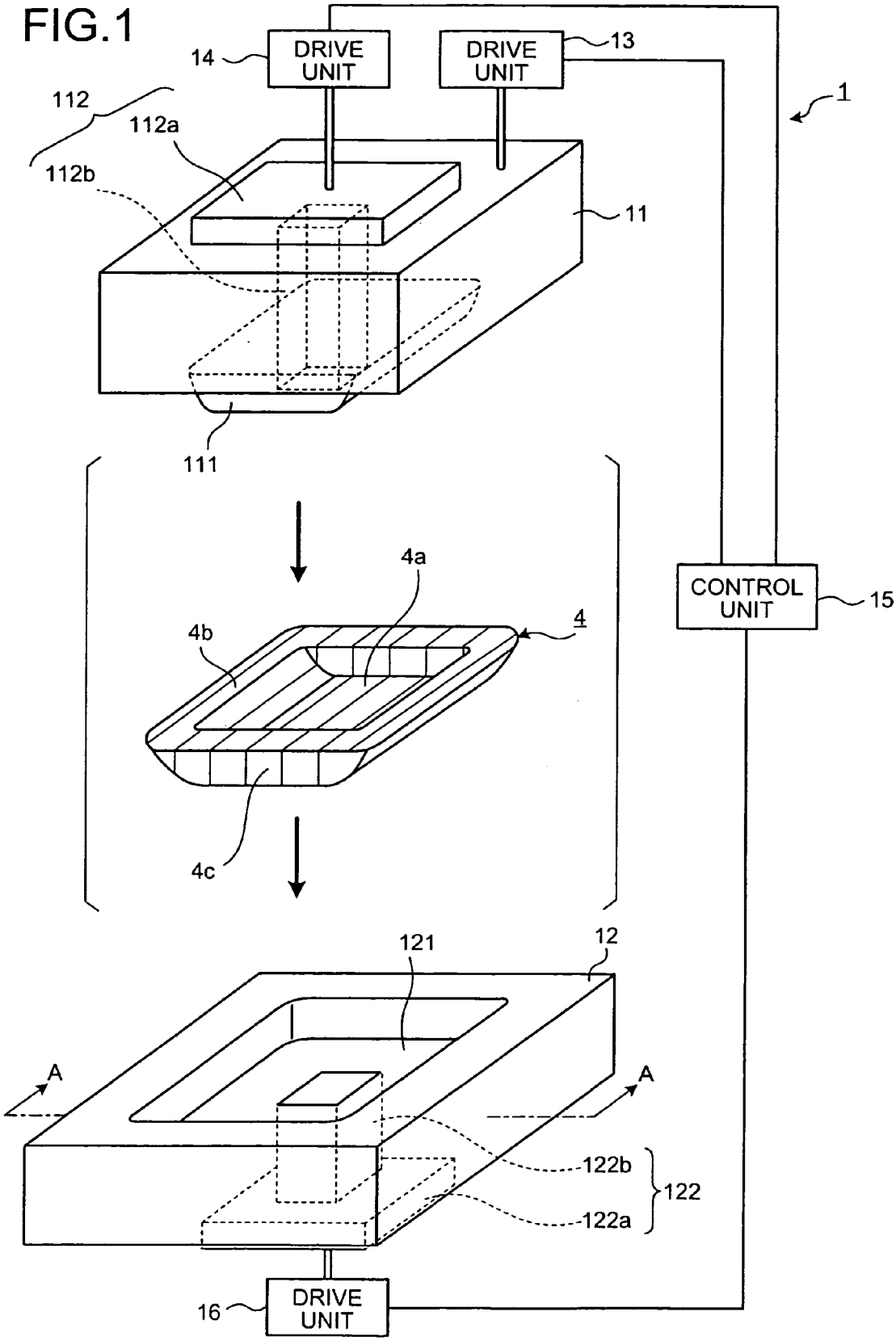
FIG. 1 shows a structure of a main part of a processing apparatus according to a first embodiment of the present invention.

FIG. 1 schematically shows a structure of a main part of a processing apparatus according to a first embodiment of the present invention. A processing apparatus 1 shown in FIG. 1 includes a pair of metal molds 11 and 12, and movable metal molds 112 and 122 which are fitted into and penetrate respective metal molds 11 and 12. The metal molds serve to apply compressive force to a wooden piece to be processed. The processing apparatus 1 forms the wooden piece into a predetermined three-dimensional shape by compression.

The metal mold 11 that applies compressive force to a wooden piece 4 to be processed from above the wooden piece 4 has a protrusion 111 which is shaped so as to be fitted to an inner side surface of the wooden piece 4. The movable metal mold 112 is fitted into a substantially central portion of the metal mold 11 so as to penetrate the metal mold 11 in a vertical direction. The movable metal mold 112 is vertically movable relative to the metal mold 11.

The movable metal mold 112 has a plate-like bottom plate portion 112*a* that abuts on a top surface of the metal mold 11 in an initial state shown in FIG. 1, and a square pole-like protruding portion 112*b* that protrudes vertically downwards from the bottom plate portion 112*a*. In the initial state shown in FIG. 1, the bottom plate portion 112*a* serves to prevent an outside air from entering a minute gap between the metal mold 11 and the protruding portion 112*b* from above the metal mold 11. In addition, in the initial state, a bottom surface (of a rectangular shape) of the protruding portion 112*b* smoothly leads to a surface of the protrusion 111 so as to form an identical plane therewith.

The metal mold 11 is connected to a drive unit 13, and moves vertically toward or away from the metal mold 12 when being driven by the drive unit 13. On the other hand, the movable metal mold 112 is connected to the other drive unit 14, and moves vertically relative to the metal mold 11 when being driven by the drive unit 14. The drive units 13 and 14 are controlled by a control unit 15.

The metal mold 12, which applies compressive force to the wooden piece 4 from below the wooden piece 4, has a depression 121 fitted to an outer side surface of the wooden piece 4. The movable metal mold 122 is fitted into a substantially central portion of the metal mold 12 so as to penetrate the metal mold 12 in a vertical direction. The movable metal mold 122 is vertically movable relative to the metal mold 12.

The movable metal mold 122 has a bottom plate portion 122*a* that abuts on a bottom surface of a main body of the metal mold 12 in the initial state shown in FIG. 1, and a square pole-like protruding portion 122*b* that protrudes vertically upwards from the bottom plate portion 122*a*. A top surface of the protruding portion 122*b* is of a rectangular shape which is congruent to the rectangular shape of the bottom surface of the protruding portion 112*b* of the movable metal mold 112. The top surface of the protruding portion 122*b* and the bottom surface of the protruding portion 112*b* are disposed so as to face with each other in the vertical direction.

The movable metal mold 122 is connected to a drive unit 16, and moves vertically relative to the metal mold 12 when being driven by the drive unit 16. The drive unit 16 is, similarly to the drive units 13 and 14 described above, controlled by the control unit 15. In the initial state shown in FIG. 1, the bottom plate portion 122*a* serves to prevent an outside air from entering a minute gap between the metal mold 12 and the protruding portion 122*b* from below the metal mold 12. Further, in the initial state, the top surface of the protruding portion 122*b* smoothly leads to the surface of the depression 121 so as to form an identical plane therewith.

Here, the metal mold 11 is electrically driven. Alternatively, however, the metal molds 11 and 12 may be screwed with each other, and the distance between the metal molds 11 and 12 or the amount of compressive force applied to the wooden piece 4 may be adjusted by a manual or automatic screwing. Still alternatively, when the protruding portion 112*b* of the movable metal mold 112 is of a cylindrical shape instead of the square pole shape as described above, the movable metal mold 122 may not be electrically driven, and instead a thread groove may be formed on each of the surfaces of the protruding portion 112*b* and the metal mold 11 that contact with each other, so that the movable metal mold 112 can be screwed on the metal mold 11 (the same applies to the movable metal mold 122).

Figure 2:
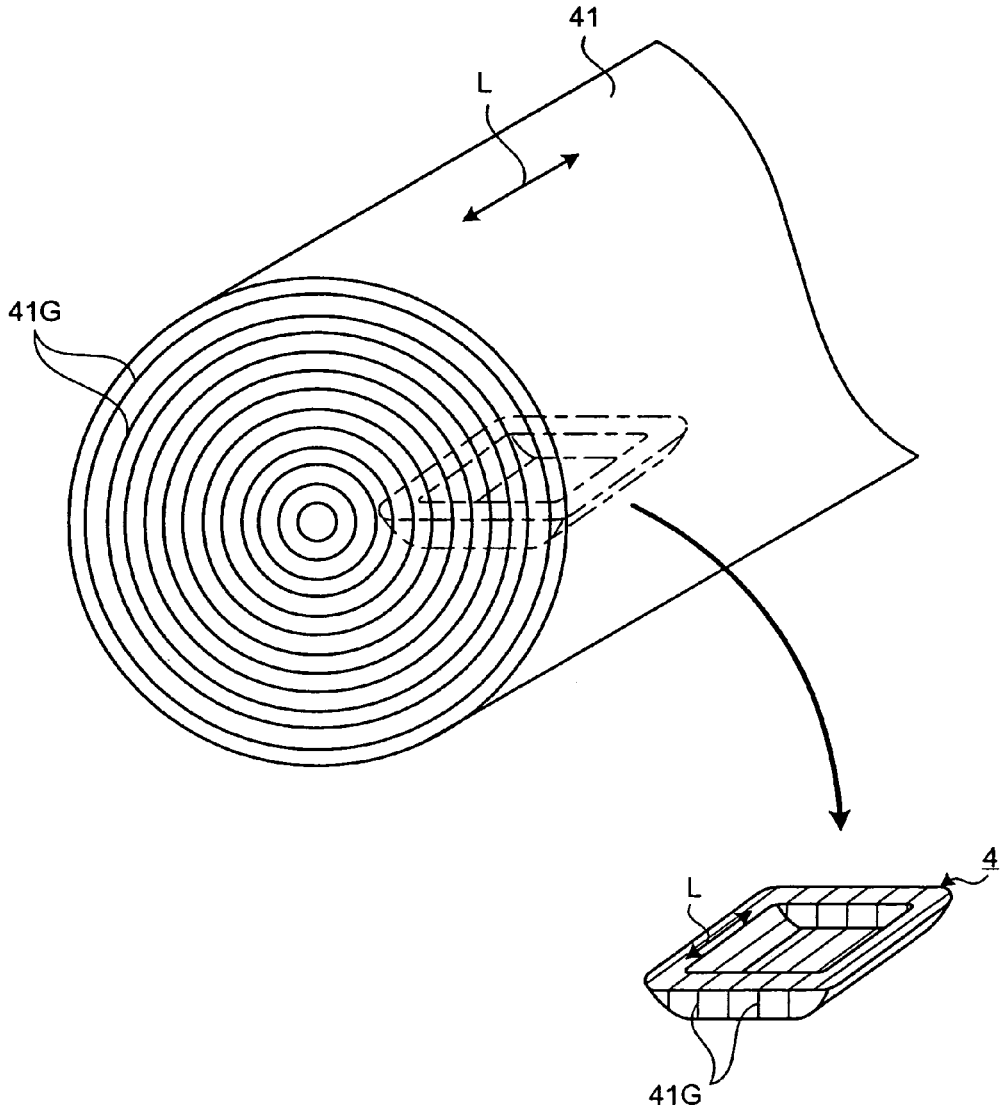
FIG. 2 schematically shows how a wooden piece is taken out from uncompressed raw wood.

A shape of the wooden piece 4 will be described. The wooden piece 4 shown in FIG. 1 includes a main plate portion 4*a* that has a substantially rectangular surface, two side plate portions 4*b* that extend from two respective sides of the main plate portion 4*a*, the sides being substantially parallel with a lengthwise direction of the main plate portion 4*a* and forming a predetermined angle with the main plate portion 4*a*, and two side plate portions 4*c* that extends from two respective sides of the main plate portion 4*a*, the sides being substantially parallel with a breadthwise direction of the main plate portion 4*a* and forming a predetermined angle with the main plate portion 4*a*. The wooden piece 4 with such a structure is taken out from an uncompressed raw wood 41 (which has a grain pattern 41G) by cutting or the like as shown in FIG. 2. The wooden piece 4 has a larger volume than a finished product by an amount to be decreased in a compression process described later.

The wooden piece 4 shown in FIG. 2 is taken out from the raw wood 41 so that the lengthwise direction of the wooden piece 4 is substantially parallel with a direction L of wooden fibers of the wooden piece 4, and the surface of the main plate portion 4*a* is a straight-grain surface. It should be noted, however, that the wooden piece 4 shown in FIG. 2 is a mere example. Alternatively, the wooden piece 4 may be taken out so that the lengthwise direction thereof is substantially parallel with the direction L of wooden fibers, and yet the main plate portion 4*a* has a flat grain surface or a surface with an intermediate grain pattern between the straight grain and the flat grain. Thus, the wooden piece to be processed is taken out from the raw wood 41 so as to satisfy the requirements for strength, appearance, or the like. In view of the above, the grain pattern of the wooden piece is not particularly shown in the accompanying drawings which will be referred to in the following description.

Here, the raw wood 41 may be selected from, for example, Japanese cypress, hiba cedar, paulownia, Japanese cedar, pine, cherry, zelkova, ebony wood, teak, mahogany, and rosewood, as most appropriate for the purpose of use of the processed wood material. The same is applied similarly to all embodiments of the present invention.

The compression process of the wooden piece 4 performed by the processing apparatus 1 will be described in details. Before the compression process, the cut-out wooden piece 4 is left in a water vapor atmosphere in high temperature and high pressure for a predetermined time period. Here, the high temperature means 100 to 230° C., and more preferably 180 to 230° C., and the high pressure means 0.1 to 3 MPa (MegaPascal), and more preferably 0.45 to 2.5 MPa. Thus, the wooden piece 4 absorbs water in excess to be softened. Thereafter, in the same water vapor atmosphere mentioned above, the wooden piece 4 is compressed. Here, instead of being left in the water vapor atmosphere of the above mentioned temperature and pressure, the wooden piece 4 may be heated by a high-frequency electromagnetic wave such as a microwave before the compression.

Figure 3:
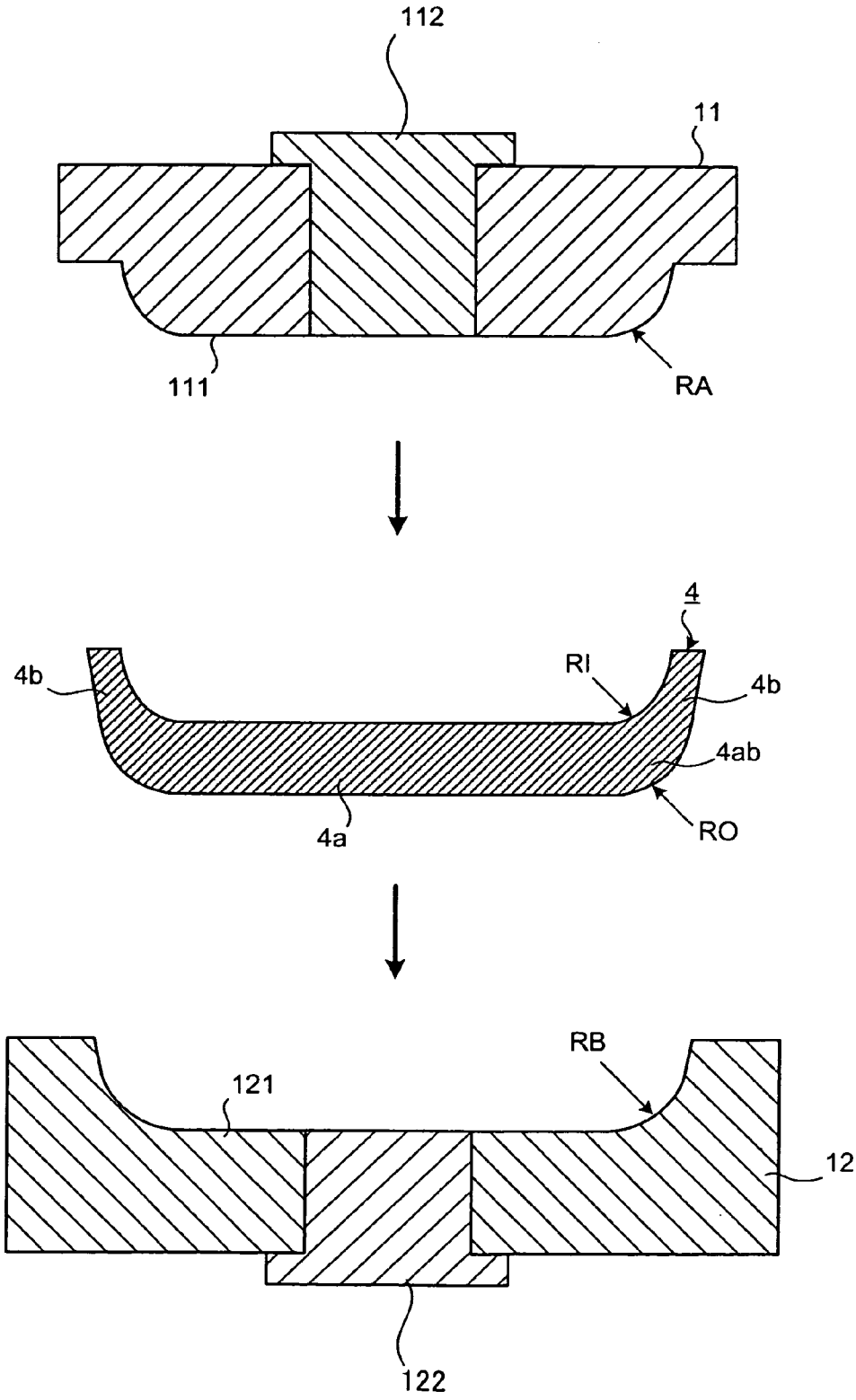
FIG. 3 is a vertical sectional view of the processing apparatus of FIG. 1 along line A-A.

FIG. 3 schematically shows how the wooden piece 4 is compressed, and is a vertical sectional view of the processing apparatus 1 and the wooden piece 4 of FIG. 1 along line A-A. As shown in FIG. 3, when radius of curvature of an internal surface of a curved portion 4*ab* extending from the main plate portion 4*a* to the side plate portion 4*b* of the wooden piece 4 is represented as RI, and radius of curvature of a curved surface, which abuts on the curved portion 4*ab*, on the protrusion 111 of the metal mold 11 is represented as RA, relation represented as RI>RA needs to hold for appropriate compression of the wooden piece 4. In other words, it is necessary that the wooden piece 4 be taken out and the protrusion 111 be designed so as to satisfy the above relation.

On the other hand, when radius of curvature of an external surface of the curved portion 4*ab* extending from the main plate portion 4*a* to the side plate portion 4*b* of the wooden piece 4 is represented as RO, and radius of curvature of a curved surface, which abuts on the external surface of the curved portion 4*ab*, on the depression 121 of the metal mold 12 is, represented as RB, relation represented as RO>RB needs to hold for appropriate compression of the wooden piece 4. In other words, it is necessary that the wooden piece 4 be taken out and the depression 121 be designed so as to satisfy the above relation.

Figure 4:
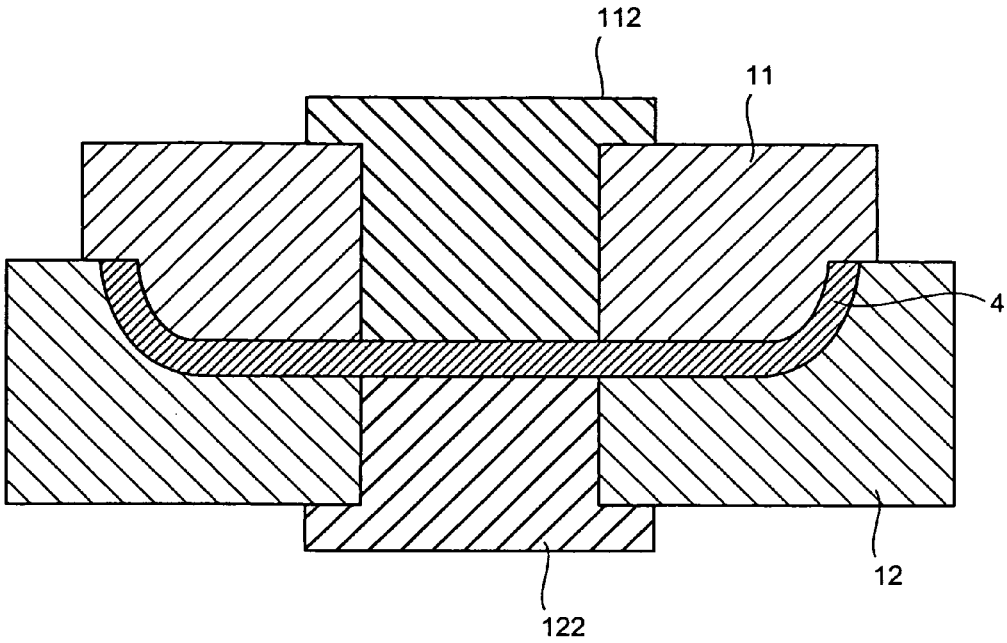
FIG. 4 is a vertical sectional view of a wooden piece being compressed by the processing apparatus according to the first embodiment of the present invention.

FIG. 4 shows the softened wooden piece 4 arranged in a predetermined position in sandwiched and compressed state and is a vertical sectional view of the same section as shown in FIG. 3. The metal mold 11 and the movable metal mold 112 are lowered by the drive unit 13, so as to sandwich the wooden piece 4 with the metal mold 12 and the movable metal mold 122 and to apply a predetermined compressive force to the wooden piece 4. In FIG. 4, the deformation of the wooden piece 4 is nearly completed. In the state shown in FIG. 4, each of the movable metal molds 112 and 122 applies compressive force to the wooden piece 4 according to the pressure provided by the drive units 14 and 16, respectively. Here, the control unit 15 controls the driving of the drive units 13, 14, and 16 so that the compressive force applied to a portion of the wooden piece 4 sandwiched by the metal molds 11 and 12 in the thickness direction, and the compressive force applied to a portion of the wooden piece 4 sandwiched by the movable metal molds 112 and 122 in the thickness direction are substantially the same.

As a result of the compression process as described above, the thickness of the compressed wooden piece 4 becomes approximately 30% to 50% of the thickness of the wooden piece 4 in the uncompressed state as cut out from the raw wood 41.

Figure 5:
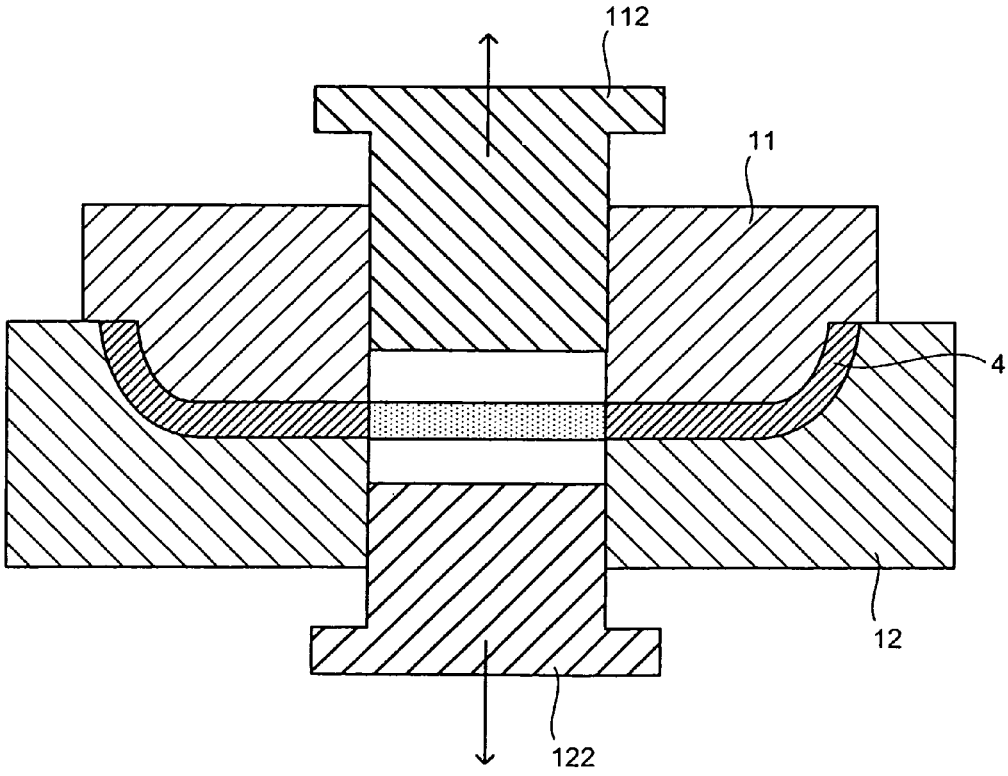
FIG. 5 is a vertical sectional view of a wooden piece in a blasting process in the processing apparatus according to the first embodiment of the present invention.

After the wooden piece 4 is left in the compressed state as shown in FIG. 4 for a predetermined time period (a few minutes to a few tens of minutes), the water vapor atmosphere around the metal molds is made to return back to an atmosphere pressure state. Thereafter, as shown in FIG. 5, the drive unit 14 moves the movable metal mold 112 quickly upwards relative to the metal mold 11 and the drive unit 16 moves the movable metal mold 122 quickly downwards relative to the metal mold 12.

When the movable metal molds 112 and 122 move so that the bottom plate portions 112*a* and 122*a* are separated from the top surface of the metal mold 11 and the bottom surface of the metal mold 12, respectively, a gap between the metal mold 11 and the movable metal mold 112 and a gap between the metal mold 12 and the movable metal mold 122 communicate with the outside air. Hence, an outside air instantaneously enters and hits a portion, which has been sandwiched and compressed by the movable metal molds 112 and 122, of the wooden piece 4. Then, water contained in the portion of the wooden piece 4 undergoes a sudden cubical expansion. As a result, an explosion occurs inside the wooden piece 4 at the portion, whereby the wooden piece 4 is broken and fractured. FIG. 5 shows the fractured portion as a dotted area.

According to one known method, a sample (wooden piece 4 in the embodiment) heated in a water vapor atmosphere in high temperature and high pressure is suddenly exposed to the air, so that the sample is exploded inside to be broken. Such method is called blasting. In the following, a process in which the movement of the movable metal molds 112 and 122 causes the blasting will be referred to as "blasting process".

After the blasting process as described above, the drive unit 13 separates the metal mold 11 from the metal mold 12 so as to release the wooden piece 4 from compression, and the wooden piece 4 is dried. In the dotted area shown in FIG. 5, the fractured components may remain without being separated from other portion of the wooden piece 4. In such case, the residual components may be removed by a simple after-treatment. As a result, the wooden piece 4 is formed into a predetermined three-dimensional shape, and at the same time an opening can be formed as defined by the protruding portions 112*b* and 122*b* of the respective movable metal molds 112 and 122 in the wooden piece 4.

Figure 6:
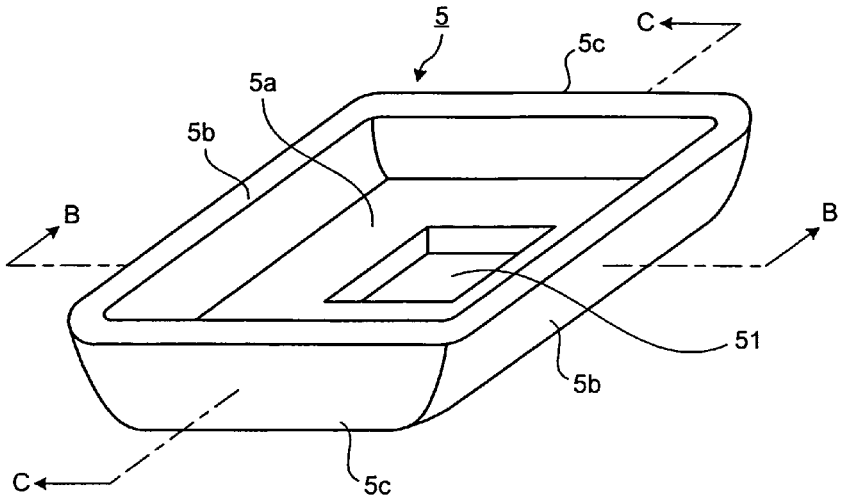
FIG. 6 is a perspective view of a structure of a compressed wood product manufactured by a processing method according to the first embodiment of the present invention.
Figure 7:
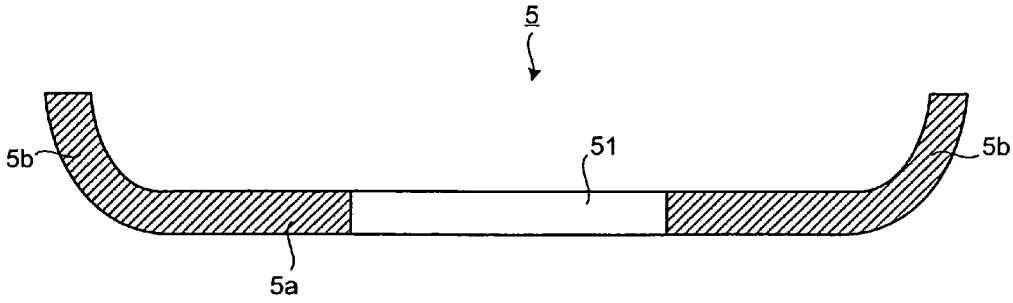
FIG. 7 is a vertical sectional view of the compressed wood product of FIG. 6 along line B-B.

FIG. 6 is a perspective view of a structure of a compressed wood product manufactured by a method of processing wood according to the first embodiment. FIG. 7 is a vertical sectional view of the compressed wood product of FIG. 6 along line B-B. A compressed wood product 5 shown in FIGS. 6 and 7 includes a main plate portion 5*a*, two side plate portions 5*b*, and two side plate portions 5*c*, corresponding to the main plate portion 4*a*, two side plate portions 4*b*, and two side plate portions 4*c* of the wooden piece 4, respectively. Further, a rectangular opening 51 is formed substantially at the center of the main plate portion 5*a*. A section of the compressed wooden product 5 along line C-C shown in FIG. 6 is similar to the sectional view along line B-B of FIG. 7 other than the dimension.

Though the formation of the rectangular opening is described above, openings and cutout portions of different shapes can be formed similarly with the use of metal molds and movable metal molds of suitable shapes corresponding to the desired shapes of the openings and cutout portions. Further, only one of the two metal molds that sandwich the wooden piece and apply compressive force to the wooden piece may be provided with a movable metal mold depending on the shapes of the openings and cutout portions.

Figure 8:
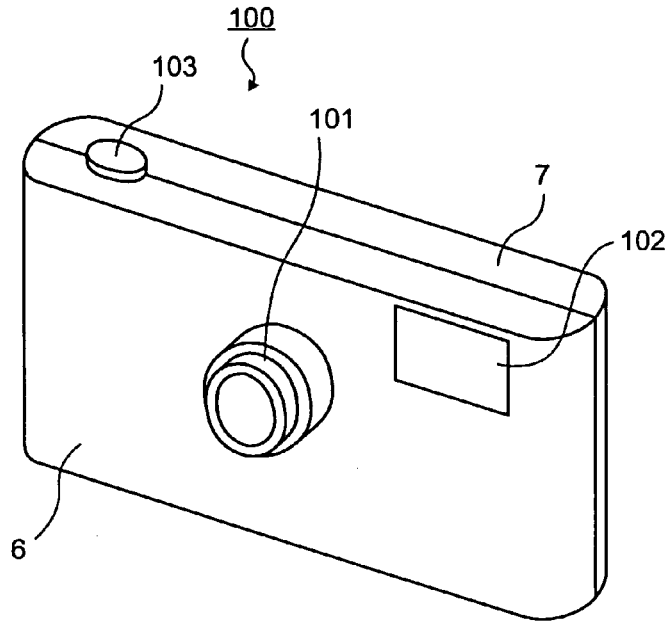
FIG. 8 is a perspective view showing an external appearance of a digital camera whose jacket material is formed from the compressed wood product manufactured by the processing apparatus according to the first embodiment of the present invention.

FIG. 8 is a perspective view showing a structure of a digital camera whose jacket material is formed from the compressed wood product manufactured with the use of a suitable metal mold and movable metal mold from the wooden piece 4 which is formed as described above. A digital camera 100 shown in-FIG. 8 includes an imaging unit 101 having an image pickup lens, a photoflash 102, and a shutter button 103, and is covered by two cover members 6 and 7. The digital camera 100 houses various electronic components and optical components (not shown) for implementing functions as the digital camera 100. For example, the digital camera 100 includes a control circuit that performs drive control related to imaging process or the like, a solid-state image pick-up device such as a charge coupled device (CCD) or a complementary metal-oxide semiconductor (CMOS), and an audio input/output device such as a microphone and a speaker.

Figure 9:
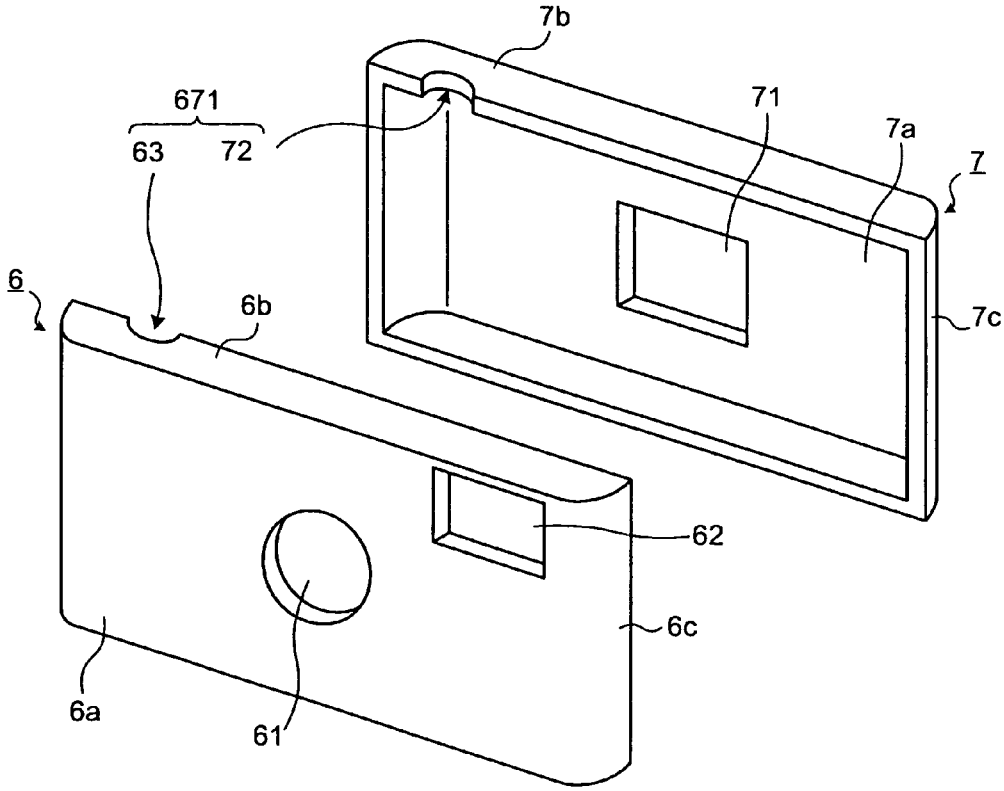
FIG. 9 is a perspective view of a structure of the jacket material of the digital camera of FIG. 8.

FIG. 9 is a schematic perspective view of a structure of the cover members 6 and 7 which are employed as jacket materials for the digital camera 100. The cover member 6 which covers a front side of the digital camera 100 has a main plate portion 6*a*, in which a cylindrical opening 61 that exposes the imaging unit 101 and a rectangular opening 62 that exposes the photoflash 102 are formed. Further, the cover member 6 has a side plate portion 6*b* in which a semicircular cutout portion 63 is formed.

On the other hand, the cover member 7 which covers a rear side of the digital camera 100 has a main plate portion 7*a*, in which a rectangular opening 71 that exposes a display unit (not shown) is formed. The display unit is provided for displaying image information and textual information, and is realized by a liquid crystal display, a plasma display, an organic electroluminescence (EL) display, or the like. Further, the cover member 7 includes a side plate portion 7*b* in which a semicircular cutout portion 72 is formed. The semicircular cutout portion 72 forms an opening 671 combined with the cutout portion 63 of the cover member 6 so as to expose the shutter button 103.

In addition to the openings and cutout portions as described above, additional openings may be formed so as to allow an attachment of a finder, or to expose an input key for reception of an operation instruction signal, or to expose a connection interface (such as a DC input terminal, or a USB connecting terminal) for an external device. Still further, an audio output hole may be provided, from which sound generated by the speaker inside the digital camera 100 is output.

The compressed wood product manufactured by the processing method according to the first embodiment can be applied as a jacket material to various electronic devices other than the digital camera, such as a portable communication terminal such as a portable telephone, a personal handyphone system (PHS) or a personal digital assistant (PDA), a portable audio device, an IC recorder, a portable television, a portable radio, remote controls for various home appliances, and a digital video. More preferably, the thickness of the cover members 6 and 7 applied as the jacket materials for these electronic devices is approximately 1.6 millimeters (mm).

According to the first embodiment of the present invention as described above, compressive force is applied to the wooden piece taken out from the raw wood in water vapor atmosphere in a higher temperature and a higher pressure than the atmospheric air. Then, at least a portion of the compressed wooden piece is exposed to the air so as to cause explosion inside the exposed portion of the wooden piece which is fractured thereby. Thus, openings and cutout portions with various shapes can be readily formed in the compressed wooden piece with a high degree of precision.

Figure 10:
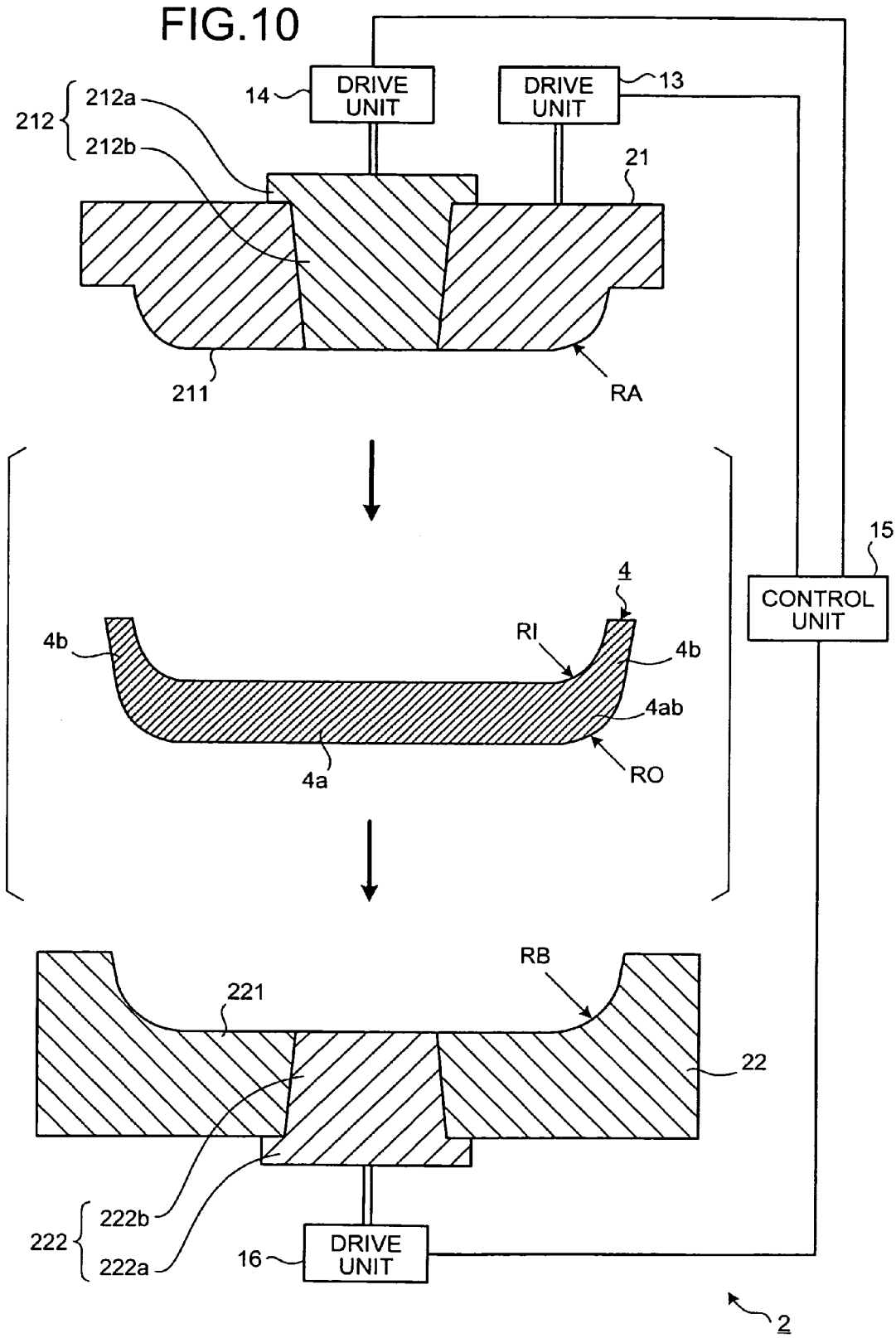
FIG. 10 shows a structure of a main part of a processing apparatus according to a variation of the first embodiment of the present invention.

FIG. 10 is a sectional view showing a structure of a main part of a processing apparatus according to a variation of the first embodiment of the present invention. A processing apparatus 2 shown in FIG. 10 has the same structure as the structure of the processing apparatus 1 other than the shapes of a pair of metal molds 21 and 22, and two movable metal molds 212 and 222. Hence, the portions with the same structure as those in the first embodiment will be denoted by the same reference characters as those of the processing apparatus 1.

The movable metal mold 212 is fitted into the metal mold 21, which applies compressive force to the wooden piece 4 from above, and penetrates the metal mold 21. The movable metal mold 212 includes a plate-like bottom plate portion 212*a*, and a protruding portion 212*b* that protrudes downwards from the bottom plate portion 212*a*. The vertical section of the protruding portion 212*b* is of a tapered shape which becomes wider as getting closer to the bottom plate portion 212*a* as shown in FIG. 10. Further, the movable metal mold 222 is fitted into the metal mold 22, which applies compressive force to the wooden piece 4 from below, and penetrates the metal mold 22. The movable metal mold 222 includes a plate-like bottom plate portion 222*a*, and a protruding portion 222*b* that protrudes upwards from the bottom plate portion 222*a*. The vertical section of the protruding portion 222*b* is also of a tapered shape which becomes wider as getting closer to the bottom plate portion 222*a*.

Due to the above-described shapes, a contact area between the metal mold 21 and the movable metal mold 212, and a contact area between the metal mold 22 and the movable metal mold 222 are larger than the contact areas of the corresponding metal molds and the movable metal molds of the processing apparatus 1, respectively. Hence, when the movable metal molds 212 and 222 are moved in the blasting process at the same speed as in the first embodiment, a portion of the wooden piece 4 can be exposed to the air faster than in the processing apparatus 1, and the cubical expansion of the water contained in the pertinent portion occurs more drastically, whereby an even finer fracture of the wooden piece 4 is allowed.

In the first embodiment, the gap is formed between the metal mold 11 and the movable metal mold 112, and between the metal mold 12 and the movable metal mold 122 so as to expose the wooden piece to the outside air during the blasting process. Therefore during the compression process or the like prior to the blasting process, the gaps need to be closed by the bottom plate portions 112*a* and 122*a*. In the variation of the first embodiment, the metal mold 21 and the movable metal mold 212, and the metal mold 22 and the movable metal mold 222 are respectively fitted with each other prior to the blasting process for preventing the outside air from invading. In the blasting process, the movable metal molds 212 and 222 move to automatically and instantaneously form a gap through which outside air can flow into.

Figure 11:
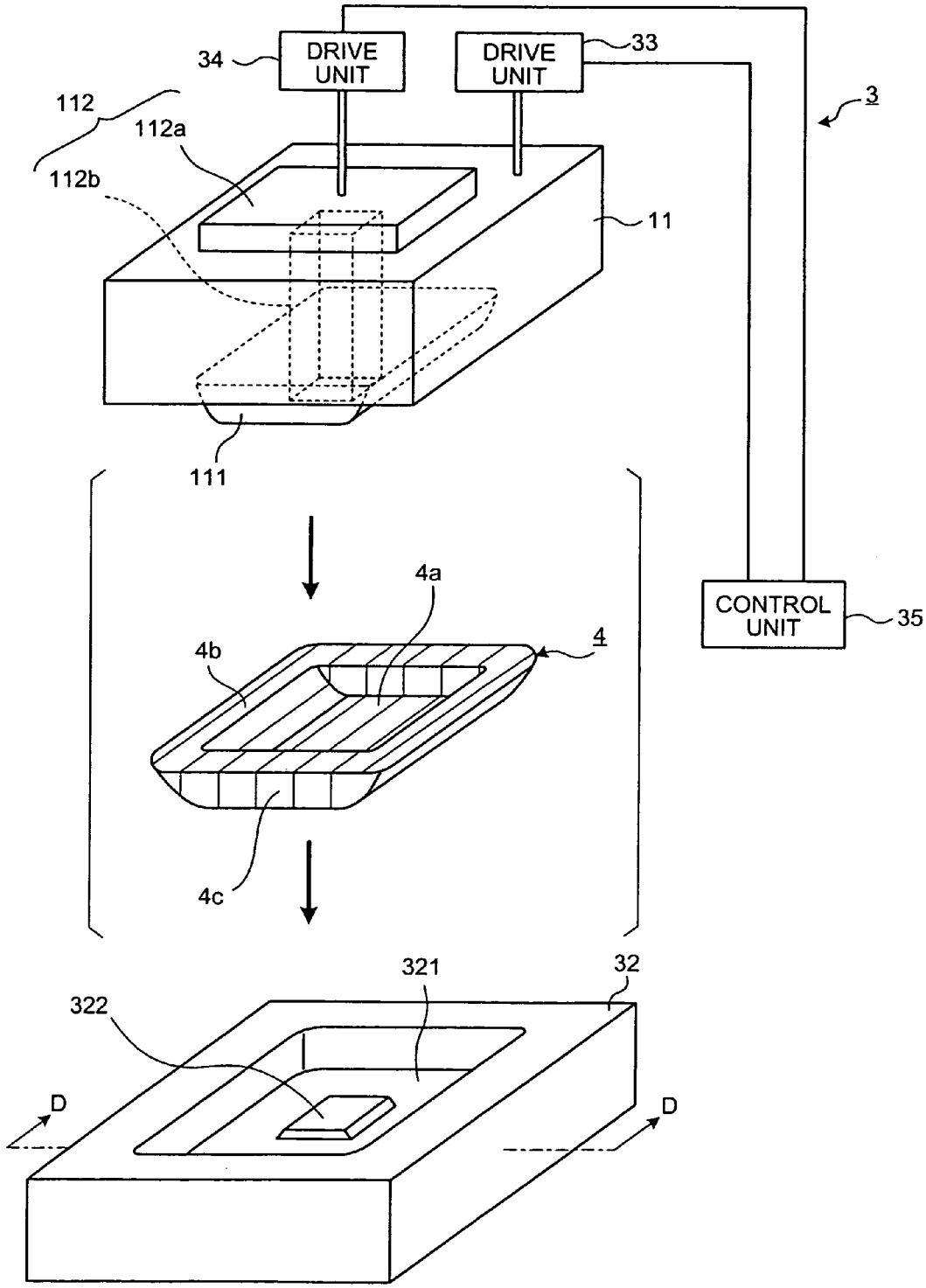
FIG. 11 shows a structure of a main part of a processing apparatus according to a second embodiment of the present invention.
Figure 12:
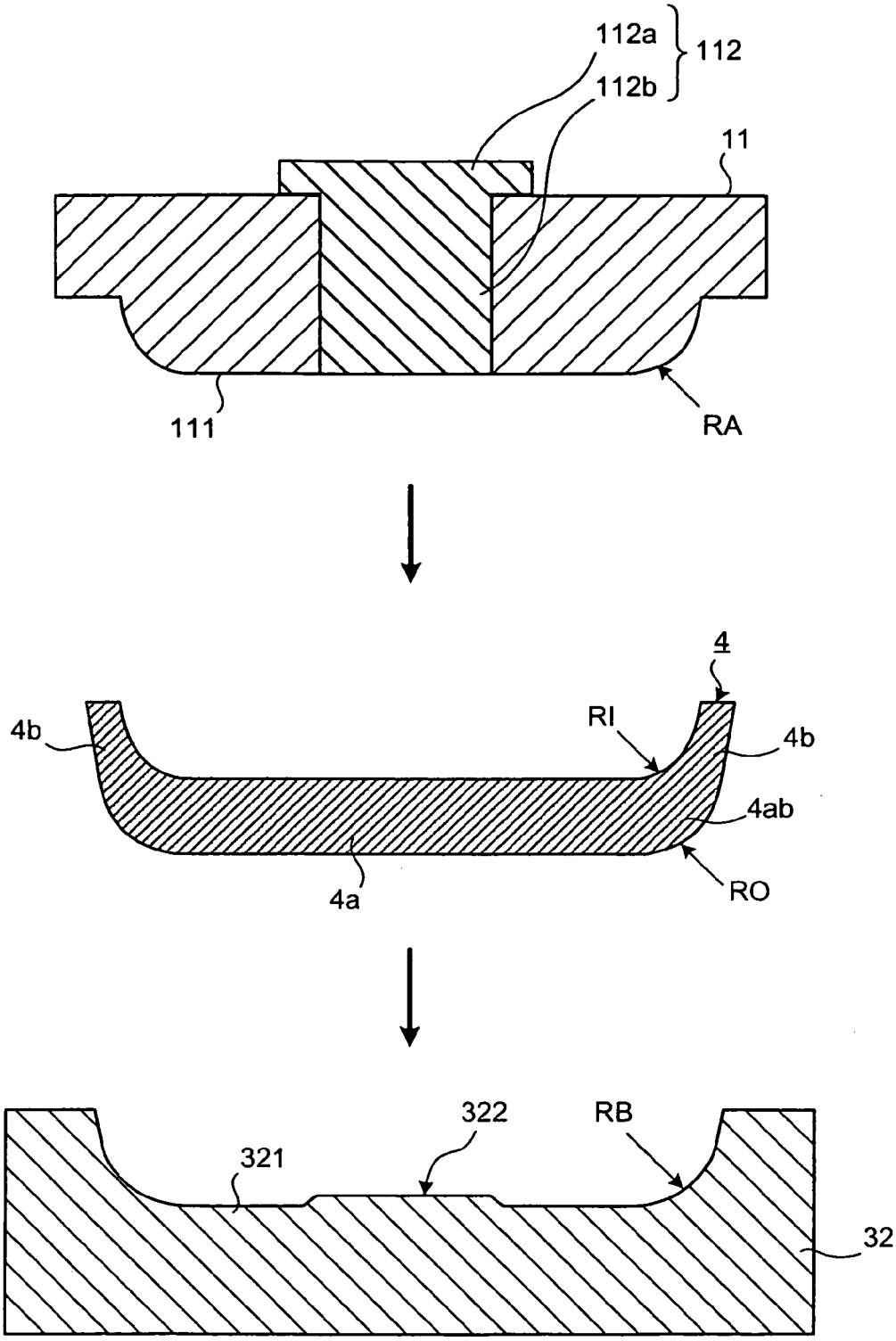
FIG. 12 is a vertical sectional view of the processing apparatus of FIG. 11 along line D-D.

FIG. 11 schematically shows a structure of a main part of a processing apparatus according to a second embodiment of the present invention. FIG. 12 is a vertical sectional view of the processing apparatus of FIG. 11 along line D-D. A processing apparatus 3 shown in FIGS. 11 and 12 includes a pair of metal molds 11 and 32, and a movable metal mold 112 fitted to the metal mold 11 so as to penetrate the metal mold 11. Similarly to the first embodiment, in the second embodiment, the wooden piece 4 is taken out from the raw wood 41, which is a raw material, as shown in FIG. 2, and the wooden piece 4 is processed into a predetermined three-dimensional shape.

The metal mold 11 and the movable metal mold 112 that apply compressive force to the wooden piece 4 from above are the same as those in the first embodiment. The metal mold 11 is connected to a drive unit 33 and vertically moves towards and away from the metal mold 32 when being driven by the drive unit 33. The movable metal mold 112 is connected to another drive unit 34, and vertically moves relative to the metal mold 11 when being driven by the drive unit 34. The drive units 33 and 34 are drive controlled by a control unit 35.

On the other hand, the metal mold 32, which applies compressive force to the wooden piece 4 from below, has a truncated pyramidal protruding portion 322 that protrudes from near the center of a bottom surface of a depression 321. A top surface of the protruding portion 322 is of a rectangular shape which is congruent to the shape of the bottom surface of the protruding portion 112*b* of the movable metal mold 112. The top surface of the protruding portion 322 and the bottom surface of the protruding portion 112*b* are arranged so as to face with each other in the vertical direction. Four side surfaces that extend from respective sides of the rectangular top surface of the protruding portion 322 down to the bottom surface of the depression 321 incline making all the same angle with the bottom surface of the depression 321, so as to form the tapered protruding portion 322 whose horizontal section gradually increases from the top surface down to the bottom surface.

Figure 13:
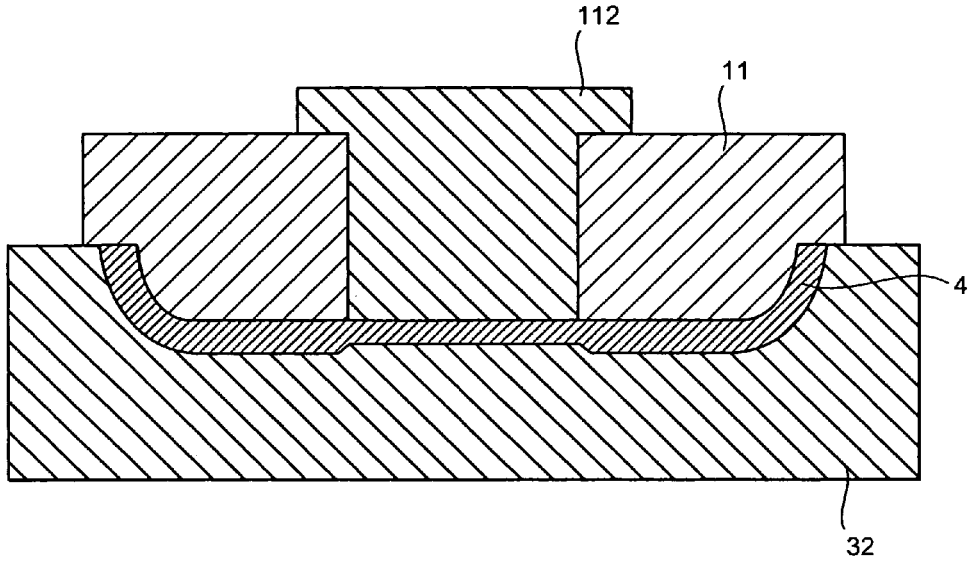
FIG. 13 is a vertical sectional view of a wooden piece being compressed by the processing apparatus according to the second embodiment of the present invention.

FIG. 13 shows the wooden piece 4 being compressed by the processing apparatus 3 (where the deformation of the wooden piece 4 is nearly completed), and is a vertical section along the same section shown in FIG. 12. Before the compression process, the wooden piece 4 is first left in the water vapor atmosphere in high temperature and high pressure for a predetermined time period similarly to the first embodiment. Then, the wooden piece 4 is sandwiched by the metal molds 11 and 32, and the movable metal mold 112 so that compressive force of a predetermined level is applied to the wooden piece 4. Here, the control unit 35 controls the movement of the drive units 33 and 34 so that the compressive force applied in a thickness direction of a portion of the wooden piece 4 sandwiched between the metal molds 11 and 32 is of the same level as the compressive force applied in a thickness direction of a portion of the wooden piece 4 sandwiched between the movable metal mold 112 and (the protruding portion 322 of) the metal mold 32.

Figure 14:
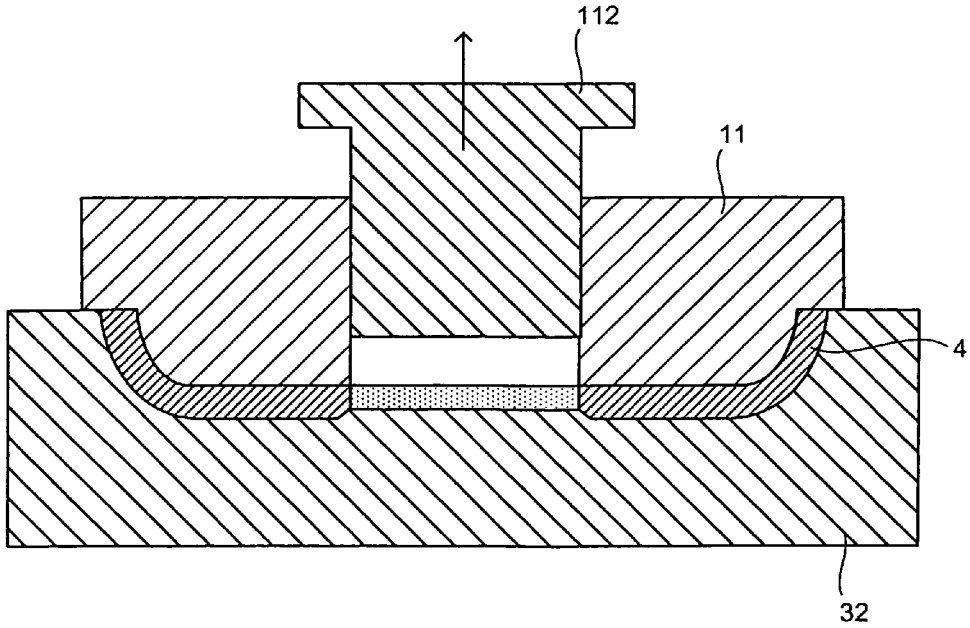
FIG. 14 is a vertical sectional view of a wooden piece in a blasting process in the processing apparatus according to the second embodiment of the present invention.

After the wooden piece 4 is left in the state shown in FIG. 13 for a predetermined time period (a few minutes to a few tens of minutes), the water vapor atmosphere around the respective metal molds is turned to the atmospheric pressure state, while the wooden piece 4 is retained in a compressed state. Thereafter, the movable metal mold 112 is suddenly pulled upward by the drive unit 34 as shown in FIG. 14 (blasting process). When the movable metal mold 112 suddenly rises and the bottom plate portion 112*a* thereof is separated from the top surface of the metal mold 11, the gap between the movable metal mold 112 and the metal mold 11 communicates with the outside air. Then, the outside air instantaneously enters the gap and hits the portion, which has been sandwiched and compressed between the movable metal mold 112 and the protruding portion 322, of the wooden piece 4. Then, water contained in the portion of the wooden piece 4 undergoes a sudden cubical expansion. As a result, an explosion occurs inside the wooden piece 4 at the portion, whereby the wooden piece 4 is broken and fractured. In FIG. 14, similarly to FIG. 5, the fractured portion is shown as a dotted area.

Figure 15:
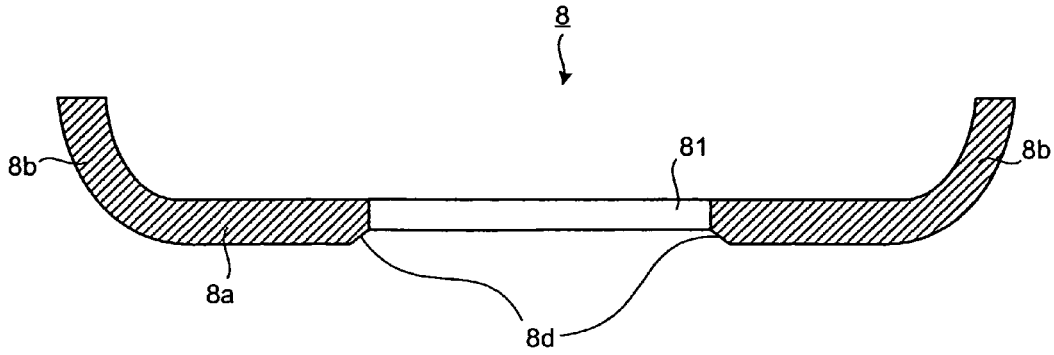
FIG. 15 is a vertical sectional view of a structure of a compressed wood product manufactured by a processing method according to the second embodiment of the present invention.

After the blasting process, the drive unit 33 separates the metal mold 11 from the metal mold 32 to release the wooden piece 4 from compression. Then, the wooden piece 4 is dried. Thereafter, the components remaining in the area shown as the dotted area in FIG. 14 are removed as appropriate, and the processing according to the second embodiment is finished. FIG. 15 is a sectional view of a structure of the compressed wood product manufactured by the above-described processes. A compressed wood product 8 shown in FIG. 15 includes a main plate portion 8*a*, two side plate portions 8*b*, and two side plate portions 8*c*, corresponding to the main plate portion 4*a*, two side plate portions 4*b*, and two side plate portions 4*c* of the wooden piece 4, respectively. Further, a rectangular opening 81 is formed substantially at the center of the main plate portion 8*a*.

The opening 81 is defined by edge portions of the wooden piece 4. Among the edge portions, an edge portion 8*d* is formed through compression by inclined side surfaces of the protruding portion 322 of the metal mold 32, and is inclined relative to the bottom surface of the main plate portion 8*a*. The edge portion 8*d* is compressed so as to be thinner than other portions of the wooden piece 4. Hence, the edge portion 8*d* is harder and stronger after compression than the other portions of the wooden piece 4. In addition, since the edge portion 8*d* has substantially the same shape as the shape of edges of a chamfered opening, the chamfering after the processing can be eliminated. Thus, the opening 81 is suitable as an opening in which various components formed from glass or the like is attached. For example, the opening 81 is suitable as the opening 62 which is provided to expose the flash 102 in the cover 6 of the digital camera 100 described in the first embodiment, or the opening 71 which is provided to expose the display unit in the cover 7.

Thus, according to the second embodiment as described above, similarly to the first embodiment, openings or cutout portions of various shapes can be readily formed at a high degree of precision in the wooden piece to which the compression process is applied.

Further, according to the second embodiment, simultaneously with the formation of the opening, the chamfering of the edge portion thereof can be performed. Hence, a separate chamfering process is unnecessary. Still further, since the compression rate of the edge portion of the opening, where a high strength is required, is higher than that of the other portion, a high strength of the edge portion of the opening can be guaranteed. Such feature is preferable when parts formed from glass or the like are attached inside the opening, for example. It should be noted that in the second embodiment, similarly to the variation of the first embodiment, the contact surface between the metal mold 11 and the movable metal mold 112 may be tapered.

The first and the second embodiments are described as preferred embodiments of the present invention. It should be noted, however, that the present invention is not limited to the two embodiments. In the above description, the wooden piece is taken out from the raw wood in a three-dimensional shape similar to the finished shape obtained through compression. The wooden piece may be, however, a plate-like wooden piece cut out from the raw wood, and the plate-like wooden piece may be processed into a predetermined three-dimensional shape through compression. A similar processing can be performed for the manufacture of a compressed wood product which has a plate-like finished shape, e.g., a floor panel.

Thus, the present invention may include various embodiments or the like that are not described above, and may be subjected to various modification in design or the like within the scope of technical concept identified in the appended claims.

What is claimed is:

1. A method of processing a wooden piece taken out from a raw wood into a predetermined three-dimensional shape, comprising:

compressing the wooden piece by applying compressive force thereto in a water vapor atmosphere of higher temperature and higher pressure than atmospheric air; and fracturing a selected portion of the compressed wooden piece by suddenly exposing the selected portion to the atmospheric air so as to cause explosion inside the exposed portion of the wooden piece.

2. A method of processing a wooden piece taken out from a raw wood into a predetermined three-dimensional shape, comprising:

compressing the wooden piece by applying compressive force thereto in a water vapor atmosphere of higher temperature and higher pressure than atmospheric air; and fracturing at least a portion of the compressed wooden piece by exposing the portion to the atmospheric air so as to cause explosion inside the exposed portion of the wooden piece;

wherein the compressing includes applying the compressive force to the wooden piece using a pair of metal molds with shapes corresponding to the three-dimensional shape and a movable metal mold that penetrates at least one of the metal molds and that is movable relative to the penetrated metal mold, and the fracturing includes exposing a portion of the wooden piece abutting the movable metal mold during compression to the atmospheric air to cause an explosion inside the wooden piece, by moving the movable metal mold while maintaining the pair of metal molds in a static state.

3. The method according to claim 1, wherein the water vapor atmosphere is 100 to 230° C. in temperature and 0.1 to 3 MPa in pressure.

4. A processing apparatus comprising:

a pair of metal molds that sandwiches a wooden piece taken out from a raw wood and applies compressive force to the wooden piece;

a movable metal mold that penetrates at least one of the metal molds, and is movable relative to the penetrated metal mold; and a drive unit that quickly moves the movable metal mold relative to the metal mold penetrated by the movable metal mold, wherein the apparatus is configured so the compressive force is applied to the wooden piece by the metal molds and the movable metal mold in a water vapor atmosphere of higher temperature and higher pressure than atmospheric air, and the drive unit is configured to quickly move the movable metal mold to suddenly expose a selected portion of the wooden piece abutting the movable metal mold during compression to the atmospheric air to cause an explosion inside the exposed selected portion of the wooden piece which is fractured thereby.

5. The processing apparatus according to claim 4, wherein the movable metal mold consists of two movable metal molds which are provided on a pair of the metal molds, respectively, and end surfaces of the two movable metal molds that abut the wooden piece at the application of the compressive force are arranged so as to face with each other.

6. The processing apparatus according to claim 4, wherein the metal mold through which the movable metal mold does not penetrate among a pair of the metal molds has a protruding portion an end surface of which faces with an end surface of the movable metal mold abutting the wooden piece at the application of the compressive force.

* * * * *